US008737859B2

(12) United States Patent
Yuasa et al.

(10) Patent No.: US 8,737,859 B2
(45) Date of Patent: May 27, 2014

(54) IMAGE FORMING APPARATUS CAPABLE OF REDUCING JAM IN FIXING UNIT

(75) Inventors: Shuutaroh Yuasa, Kanagawa (JP); Takeshi Uchitani, Kanagawa (JP); Takamasa Hase, Tokyo (JP); Yutaka Ikebuchi, Kanagawa (JP); Hiroshi Yoshinaga, Chiba (JP); Takuya Seshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/608,128

(22) Filed: Sep. 10, 2012

(65) Prior Publication Data

US 2013/0136479 A1 May 30, 2013

(30) Foreign Application Priority Data

Nov. 30, 2011 (JP) ..... 2011-262617

(51) Int. Cl.
*G03G 15/20* (2006.01)

(52) U.S. Cl.
USPC ..... 399/67; 399/69

(58) Field of Classification Search
USPC ..... 399/67, 69, 322, 323, 66
See application file for complete search history.

(56) References Cited

U.S. PATENT DOCUMENTS

| | | | |
|---|---|---|---|
| 6,778,804 | B2 | 8/2004 | Yoshinaga et al. |
| 2011/0211876 | A1 | 9/2011 | Iwaya et al. |
| 2011/0222926 | A1 | 9/2011 | Ueno et al. |

FOREIGN PATENT DOCUMENTS

| | | |
|---|---|---|
| JP | 2005-173486 | 6/2005 |
| JP | 2009-025464 | 2/2009 |

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming device forms a toner image on a recording medium. The recording medium goes through a fixing nip N between a fixing member and a pressure member in a fixing unit where the toner image is fixed on the recording medium. A fixing temperature detector detects the temperature of the fixing member. A fixing temperature control unit controls a heater that heats the fixing member so that the detected temperature becomes a target temperature. A size control unit of white space sets a white space at a tip of the recording medium in a direction of the recording medium movement. When a paper counter counts more than a predetermined paper count, the size control unit increases the size of the white space. The fixing temperature control unit decreases the target fixing temperature when the white space goes through the fixing nip.

17 Claims, 4 Drawing Sheets

IMAGE FORMING APPARATUS CAPABLE OF REDUCING JAM IN FIXING UNIT

CROSS-REFERENCE TO RELATED APPLICATION

This patent application is based on and claims priority pursuant to 35 U.S.C. §119 to Japanese Patent Application Nos. 2011-262617 filed on Nov. 30, 2011 in the Japanese Patent Office, the entire content of which is hereby incorporated by reference herein.

BACKGROUND

1. Technological Field

The exemplary embodiments described herein relate to an image forming apparatus that has a fixing unit, such as a copier, a printer, a facsimile machine, a multi-functional digital machine, etc.

2. Description of the Related Art

In electrophotography, an image forming unit makes an electrostatic latent image on a photoconductor, develops it using toner, and transfers the developed toner image to a sheet of paper. A fixing unit then fixes the toner image on the paper. The fixing unit has a heated fixing member (a fixing roller, a fixing belt, etc.) and a pressure member (a pressure roller, etc.). When the toner image on the paper passes through a fixing nip formed between the fixing member and the pressure member, the toner image is heated, pressed to the paper, and fixed on the paper.

Some fixing units have a separating plate or a separating claw to separate the paper having a fixed toner image thereon from the fixing member. However separation by the separating plate or the separating claw sometimes damages the surface of the image or the fixing member. Therefore, some fixing units don't have the separating plate or the separating claw. But such fixing units have the following problem.

After the tip of paper goes through the fixing nip, and before it reaches the output paper roller, it is supported and carried by only a fixing nip. Therefore, movement of the tip of the paper is in an unstable state. Especially, because thin paper is soft, thin paper is easily adhered to the fixing member and a paper jam occurs often. Toner is melted by heat of the fixing member and works like glue. The thin paper is adhered to the fixing member or the pressure member by toner, wrapped around the fixing member or the pressure member, and a paper jam occurs. This type of paper jam is called "a wrapping jam".

As shown in Japanese Patent Publication No 2005-173486 (JP 2005-173486-A), the wrapping jam can be prevented by setting a white space (that means no toner) at the tip of the paper, but too large of a white space means a lack of image information. Therefore the image forming apparatus shown in Japanese Patent Publication No 2005-173486 (JP 2005-173486-A) has a separating claw that can be moved to contact and depart from the fixing member and the pressure member. Further, the size of the white space in the direction of paper moving can be set. When the size of the white space is more than a predetermined value, the separating claw departs from the fixing member and the pressure member. When the size of the white space is less than a predetermined value, the separating claw contacts the fixing member and the pressure member, thus preventing a wrapping jam. However, when the separating claw is used, the problems related to the separating claw occur. Moreover, this technology does not consider time degradation. As time goes on, the wrapping jam occurs more frequently. So, even in this technology, there is probability that the wrapping jam occurs.

SUMMARY

The exemplary embodiments described herein provides an image forming apparatus which includes a toner image forming device that forms a toner image on a recording medium and a fixing unit which includes a fixing member, a pressure member that presses the fixing member to form a fixing nip, a heater that heats the fixing member, and a fixing temperature detector that detects the temperature of the fixing member. The image forming apparatus also includes a recording medium counter that counts recording media processed by the image forming apparatus, and a size control unit of white space at tip portion that controls the toner image forming device not to form the toner image at a tip of the recording medium in a direction of moving of the recording medium to make a white space of a predetermined size, and to increase the white space size when the number counted by the recording medium counter is more than a predetermined number. The image forming apparatus further includes a fixing temperature control unit that controls the heater to be a target fixing temperature, and decreases the target fixing temperature when the white space on the recording medium passes the fixing nip and the number counted by the recording medium counter is more than a predetermined number.

The recording medium counter can operate by counting a number of the recording medium, or by determining a total length of the recording medium which is used, for example. The total length can be determined by counting information related to a moving time or circumferential travel of a roller, for example.

The invention also includes an image processing method. The image processing method includes forming a toner image on a recording medium with a white space at tip portion of the recording medium, and transporting the recording medium with the toner image through a fixing nip formed between a fixing member controlled to maintain a target fixing temperature and a pressure member that presses the fixing member. The method further includes determining an amount of recording media which have been processed, and changing a size of the white space and the target fixing temperature according to the amount of the recording media which have been processed.

BRIEF DESCRIPTION OF THE DRAWINGS

A more complete appreciation of the exemplary embodiments described herein and many of the attendant advantages thereof will be more readily obtained as the same becomes better understood by reference to the following detailed description when considered in connection with the accompanying drawings, wherein.

DETAILED DESCRIPTION

Figure 1:
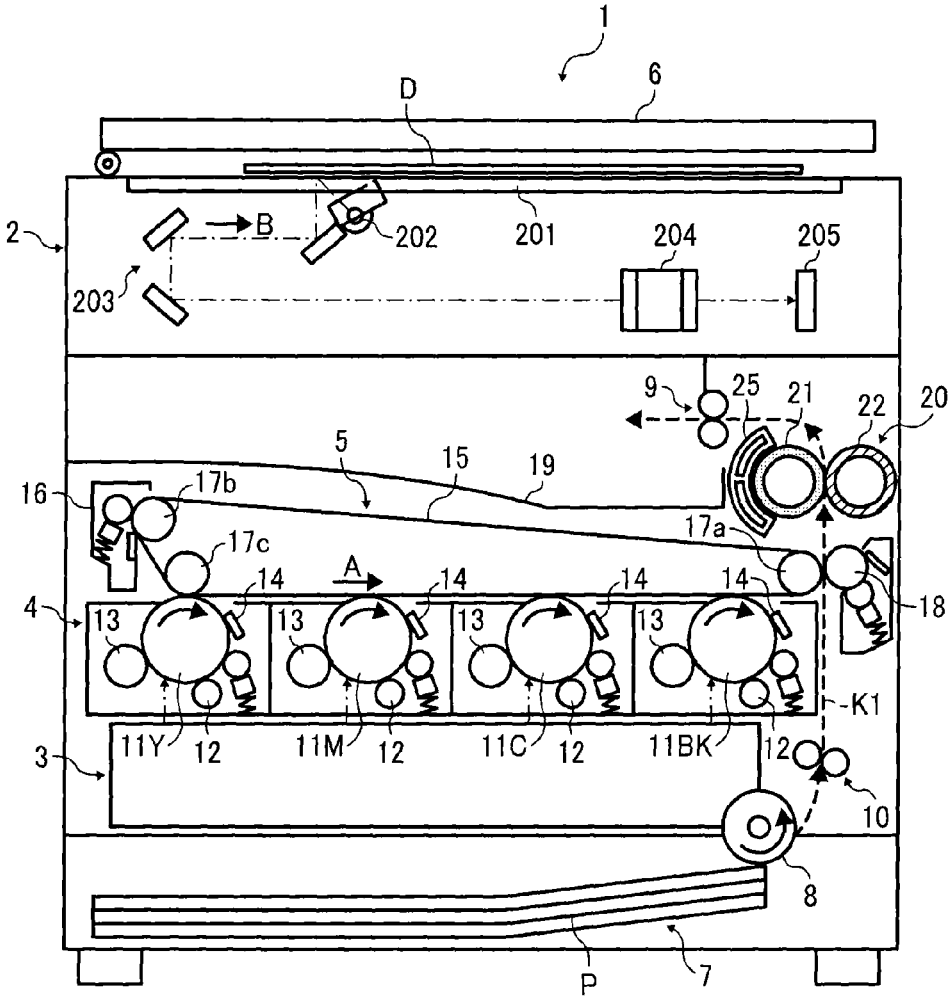
FIG. 1 is a schematic diagram showing an exemplary configuration of an image forming apparatus.

An exemplary image forming machine 1 shown in FIG. 1 is a tandem type color copier and a digital machine. It can be used as a printer by connecting to a network or PC. The image forming apparatus 1 has a scanner 2 that reads the information of a document D, an exposure unit 3 to expose a photoconductor for each color by a laser beam that is generated based on the information read by scanner, an image forming unit 4 that forms each color toner image, and a transfer unit 5 that transfer the toner image to a recording medium.

The image forming apparatus has a paper feeding unit 7 that stores paper P as a recording medium, and a fixing unit 20 with an electromagnetic induction heating unit to fix the toner image transferred by a transfer unit 5 on the paper P. The scanner 2 has a contact glass 201, an exposure lamp 202, an optical system that includes a number of mirrors 203, a lens 204, and an image pickup device 205 such as CCD color line sensors. A platen 6 presses the document D set on the contact glass.

The image forming unit 4 has four image forming devices. There are four photoconductor drums 11Y, 11M, 11C, and 11B. Each photoconductor forms one color toner image of yellow, magenta, cyan, and black. Each image forming device includes a charger 12, a developing unit 13, and a cleaning unit 14 around the each photoconductor.

The transfer unit 5 has three rollers 17*a*, 17*b*, and 17*c*, an intermediate transfer belt 15 that is wrapped around the above three rollers and contacts the surface of the photoconductor drums 11Y, 11M, 11C, and 11B. There is an intermediate transfer belt cleaning unit 16 to clean residual toner on the intermediate transfer belt 15 and a second transfer roller 18 that faces the roller 17*a* across the intermediate transfer belt 15. The roller 17*a* is a driving roller to rotate the intermediate transfer belt 15 in the direction of arrow A shown in FIG. 1. The roller 17*a* works as a second transfer opposing roller to support a second transfer roller 18.

The paper feeding unit 7 has a feeding roller 8 to feed one sheet of paper from layered papers P on a tray, a pair of carrying rollers 10, a pair of output paper rollers 9, a pair of resist rollers, and paper guides. These rollers and guides are in the paper feeding path. An output paper tray 19 is in the open space under the scanner 2

The fixing unit 20 has a fixing roller 21 as the fixing member, a pressure roller 22 as the pressure member that presses the fixing roller 21, and an induction heating unit 25 that faces fixing roller 21. Further details of the fixing unit 20 are described below.

A color copy image forming action in this image forming apparatus is explained. The scanner 2 photoelectrically detects the image information of the document D set on the contact glass. In detail, the image of the document D on the contact glass is scanned by a lamp 202 and mirrors 203 moving in a horizontal scanning direction (an arrow B shown in FIG. 1).

A light reflected by the document D is focused on an acceptance surface of the image pickup device 205 by the mirrors 203 and the lens 204. The image pickup device 205 transforms color image information of the document D from color separation lights composed of RGB (red, green and blue) to electrical image signals. A processing circuit processes the electrical image signals using various types of processing such as color conversion, color calibration and spatial frequency processing and obtains color image information for yellow, magenta, cyan and black.

The color image information is sent to the exposure unit 3. The exposure unit 3 exposes laser beams modulated based on the color information to the photoconductor drums 11Y, 11M, 11C, and 11BK corresponding to each color using a polygon mirror that rotates at a high speed and scans the laser beam towards the photoconductor drum axis.

The four photoconductor drums 11Y, 11M, 11C, and 11BK rotate in clockwise direction shown in FIG. 1. The surfaces of photoconductor drums 11Y, 11M, 11C, and 11BK are charged uniformly by chargers 12, a charging process. After charging, the charged surfaces of the photoconductor drums rotate to an exposure position where they are exposed to a corresponding laser beam that is modulated by a corresponding color signal yellow, magenta, cyan, and black, thus forming a corresponding electrostatic latent image, an exposure process.

The laser beam corresponding to the yellow image information is exposed on the surface on the photoconductor 11Y, shown as the first one on the left, thus forming the electrostatic latent image corresponding to the yellow image information on the photoconductor drum 11Y. Similarly the laser beam corresponding to the magenta image information is exposed on the surface on the photoconductor 11M, shown as the second one from the left, thus forming the electrostatic latent image corresponding to the magenta image information on the photoconductor drum 11M.

The laser beam corresponding to the cyan image information is exposed on the surface on the photoconductor 11C, shown as the third one from the left, thus forming the electrostatic latent image corresponding to the cyan image information on the photoconductor drum 11C. The laser beam corresponding to the black image information is exposed on the surface on the photoconductor 11BK, shown as the fourth one from the left, thus forming the electrostatic latent image corresponding to the black image information on the photoconductor drum 11BK.

After the exposure process, the latent image on the surface of each of the photoconductor drums 11Y, 11M, 11C, 11BK is rotated in to contact with the corresponding developing unit 13 to develop each latent image into a corresponding color toner image, a developing process.

After the developing process, each toner image on the photoconductor drums 11Y, 11M, 11C, and 11BK contacts the intermediate transfer belt 15. At each contact point, there is a transfer bias roller that contacts the inner surface of the intermediate transfer belt, and each color toner image on the each photoconductor drums 11Y, 11M, 11C, and 11BK is transferred to the intermediate transfer belt 15 at the point of the corresponding transfer roller and superimposed sequentially, thus creating a full color toner image on the intermediate transfer belt 15, a first transfer process.

After the first transfer process, the residual toner on the surface of the photoconductor drums 11Y, 11M, 11C, and 11BK is removed by the cleaning unit 14, a cleaning process. The residual charge on the surface of the photoconductor drums 11Y, 11M, 11C, and 11BK is neutralized by a neutralization unit.

The full color toner image on the intermediate transfer belt 15 faces the second transfer roller 18. In this position, the second transfer nip is formed between the second transfer opposing roller 17*a* and the second transfer roller 18 across the intermediate transfer belt 15. The full color toner image on the intermediate transfer belt 15 is transferred to the paper P at this second transfer nip, a second transfer process.) Residual toner on the intermediate transfer belt 15 that is not transferred to the paper P is removed by the intermediate transfer belt cleaning unit 16. Then a transfer action by the intermediate transfer belt 15 is finished.

The paper P is carried from the feeding paper unit 7 located at the lower part of the machine to the second transfer nip via the carrying path K1 shown by a dotted arrow in FIG. 1 that includes a feeding roller 8, a pair of carrying rollers 10 and resist rollers. There are many sheets of paper P in the feeding paper unit 7, and when the paper feeding roller 8 rotates in counter clockwise direction shown by an arrow in FIG. 1, the sheet of paper P on top of the stack of papers is carried to the carrying path K1.

The paper P carried to the carrying path K1 is carried to the resist roller by a pair of carrying rollers 10. When the tip of the paper S reaches the resist roller nip, the paper carrying is stopped. Synchronizing the toner image movement on the intermediate transfer belt 15, the resist roller is rotated. Then the paper P is carried to the second transfer nip where the color toner image is transferred to the paper P.

The paper P receiving the color toner image at the second transfer nip is carried to the fixing unit 20. When the paper passes through the fixing unit 20, the heat and pressure applied by the fixing roller 21 and the pressure roller 22 fix the color toner image on the paper, a fixing process. After the fixing process, the paper P is outputted to the output paper tray 19 by the pair of output paper rollers 9. The image forming process is completed.

Figure 2:
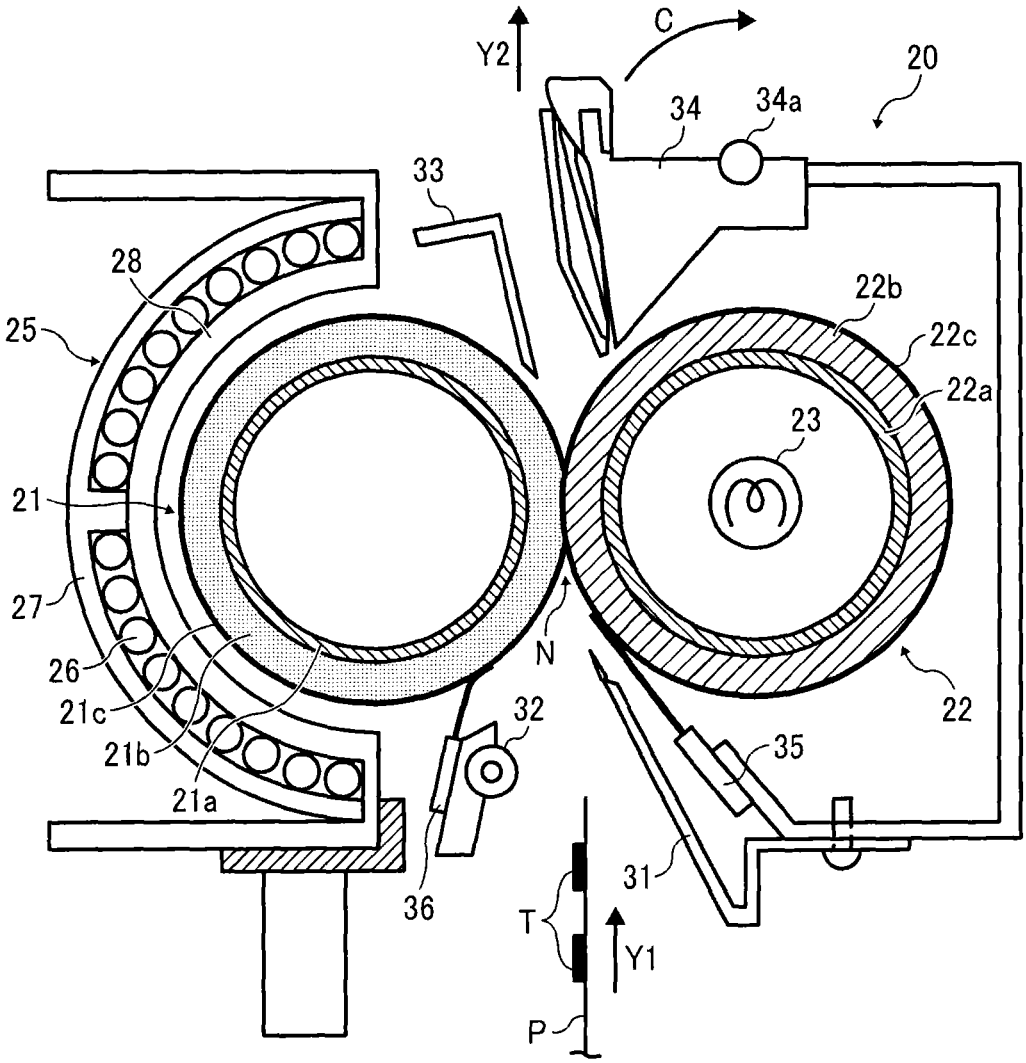
FIG. 2 is a schematic cross-sectional view of an exemplary fixing unit.

FIG. 2 is a cross-sectional view of the fixing unit 20. The fixing unit 20 shown in FIG. 2 includes the fixing roller 21 as the fixing member, the pressure roller 22 as the pressure member that presses the fixing roller 21, induction heating unit 25 (magnetic flux making unit) that faces fixing roller 21, an entrance guide plate 31, a spur guide plate 32, a separating guide plate 33, an exit guide plate 34 and thermistors 35 and 36.

The fixing roller 21 is made by layering a core metal 21 such as iron or stainless steel, a heat-insulating elastic layer 21*b* such as foamed silicon rubber, and a sleeve layer 21*c* on top. Its external diameter is about 40 mm. The sleeve layer 21*c* of the fixing roller 21 has a multilayer structure body that has a base material layer, a first oxidation resistant layer, a heat layer, a second oxidation resistant layer, an elastic layer and a release layer from the inside.

The base material layer in the sleeve layer 21*c* has a thickness of about 40 μm. The first oxidation resistant layer and the second oxidation resistant layer is a nickel strike plating having a thickness less than 1 μm. The heat layer is 10 μm thickness copper. The elastic layer is silicon rubber with a thickness of about 150 μm. The release layer is made of PFA (tetrafluoroethylene perfluoroalkylvinyl ether copolymer) with a thickness of about 30 μm.

In the above fixing roller 21, magnetic flux from the induction heating unit 25 heats the heat layer in the sleeve layer 21*c* by electromagnetic induction. However, the structure of the fixing roller is not limited to this type. For example, the fixing roller 21 may be constructed such that the sleeve layer 21*c* is not adhered to the heat-insulating elastic layer 21*b* (fixing assistant roller) and may be used as a separate body. However, when sleeve layer 21*c* is made as a separate body (that is a fixing sleeve), it is preferable that a stopper is set to prevent thrust direction movement of the fixing sleeve.

The pressure roller 22 has an elastic layer 22*b* made of silicon rubber and a release layer 22*c* made of PFA on a cylindrical member 22*a* made of iron or aluminum. The thickness of the elastic layer 22*b* is 1-5 mm. The thickness of the release layer 22*c* is 20-200 μm. The pressure roller 22 presses the fixing roller 21 at a fixing nip N.

In this embodiment, the pressure roller 22 has a heater 23 such as an internal halogen heater driven by electric power to heat the fixing roller 21. Radiation heat from heater 23 heats the pressure roller and the surface of the fixing roller 21 is heated by the pressure roller 22.

The induction heating unit 25 includes a coil unit 26 (an exciting coil), a core unit 27 (an exciting coil core), and a coil guide 28. The coil unit 26 is made by winding litz wire around the coil guide 28. The coil guide 28 covers or wraps around a part of an outer periphery of the fixing roller 21. The coil unit 26 is set along the direction normal to the paper on the coil guide 28. The coil guide 28 is made of a heat resistant resin like PFT (polyethylene terephthalate) that includes 45% glass material, for example, and supports the coil unit 26.

In this embodiment, the gap between the outer periphery of the fixing roller 21 and its facing surface of the coil guide 28 in the induction heating unit 25 is 2±0.1 mm. The core unit 27 includes a ferromagnetic body like ferrite having a relative magnetic permeability equal to about 2,500 to generate magnetic flux toward the heating layer 21*c* in the fixing roller 21. The core unit 27 includes an arch core, a center core and a side core. In this embodiment, the induction heating unit 25 is located on the lateral side of the fixing roller 21 (in the left side of FIG. 2).

The spur guide plate 32 that lines up a number of spurs laterally is in a position facing the fixing roller 21 in the fixing unit 20 and at the upstream side from the fixing nip N in the direction of the paper moving, hereinafter referred to as the upstream side. The spur guide plate 32 faces a side of the paper P with the toner image and guides the paper P to the fixing nip N. The periphery of the spurs is formed like saw teeth to prevent making the paper dirty when the toner image T on the paper P contacts the spurs.

The separating guide plate 33 faces the fixing roller 21 and is on the downstream side of the fixing nip N in the direction of the paper moving, hereinafter called the downstream side, faces a fixed side of the paper P, and does not contact the fixing roller 21. The separating guide plate 33 prevents the paper from the fixing nip N adhering to the fixing roller 21. If the paper adheres to the fixing roller 21 after fixing, the separating guide plate 33 contacts the tip of the paper P and separates it from the fixing roller 21.

The thermistor 36 is a contact-type temperature sensor that contacts the fixing roller 21 and is positioned near the fixing nip N at the upstream side of the fixing nip N. The thermistor 36 is disposed at the end portion of the fixing roller 21 in its axis direction (a paper width direction). The thermistor detects the surface temperature of the fixing roller 21. A thermopile or other type of a noncontact-type temperature sensor is positioned near the surface of the fixing roller 21 and at the center of the fixing roller 21 in its axis direction. The thermopile is a device to measure the temperature of an object based on the infrared ray radiation from the object.

The infrared ray radiation from the object is absorbed by a thermal conversion membrane in the thermopile and converted to heat. The heat is detected as the temperature by many minute thermocouples formed on the membrane. A controller, explained in detail below, controls heating by the induction heating unit 25 based on the detected temperature on the surface of the fixing roller 21 (the fixing temperature) by the thermistor 36 and the above-described thermopile. In this embodiment, the controller controls the induction heating unit 25 to keep the fixing temperature from 160° C. to 165° C. in the fixing process (when the paper is passing the fixing unit).

The thermistor 35 is a contact-type temperature sensor that contacts the pressure roller 22 and is positioned near the fixing nip N and at the upstream side of the fixing nip N. The thermistor 35 is at the end portion of the pressure roller 22 in its axis direction (a paper width direction). The thermistor 35 detects the surface temperature of the pressure roller 22. A thermopile that is a noncontact-type temperature sensor is positioned near the surface of the pressure roller 22 and at the center of the pressure roller 22 in its axis direction. The controller which is explained below controls heating by the heater 23 based on the detected temperature on the surface of the pressure roller 22 by the thermistor 35 and the above thermopile.

The entrance guide plate 31 faces the pressure roller 22 and contacts the back side of the paper P, the side without the toner. This entrance guide plate 31 guides the paper P to the fixing nip N. The exit guide plate 31 faces the pressure roller 22 and contacts the back side of the paper P sent from the fixing nip N at the downstream side of the fixing nip N. The exit guide plate 31 is rotatable in the direction of the arrow C in FIG. 2 about an axis 34*a*. This exit guide plate 31 guides the paper P sent from the fixing nip N to a paper carrying path after the fixing process.

The above fixing unit 20 operates as follows. A driving motor rotates the fixing roller 21 in the counterclockwise direction shown in FIG. 2. The rotation of the fixing roller 21 rotates the pressure roller 22 in the clockwise direction. The sleeve layer 21*c* facing the induction heating unit 25 in the fixing roller 21 is heated by the magnetic flux generated in induction heating unit 25.

An oscillating circuit in an electrical power supply that can change its frequency applies high frequency alternate current from 10 kHz to 1 MHz (preferably from 20 kHz to 800 kHz) to the coil unit 26 in the induction heating unit 25. An alternating magnetic field is formed by the coil unit 26 towards the sleeve layer 21*c* in the fixing roller 21. The alternating magnetic field causes an eddy current in the heating layer in the sleeve layer 21. Joule heat corresponding to the resistance of the heating layer is generated in the heating layer. As a result, the sleeve layer 21*c* in the fixing roller 21 is heated by induction heating in its heating layer.

The surface of the fixing roller heated by the induction heating unit 25 contacts the pressure roller 22 at the fixing nip N. The toner image on the paper P is heated and melted at the nip. In detail, the paper P that has a toner image T made by the image making process is guided by the entrance guide plate 31 or the spur guide plate 32, carried in the direction of arrow Y1 in FIG. 2 and sent to the fixing nip N between the fixing roller 21 and the pressure roller 22.

Heat from the fixing roller 21 and pressure by the pressure roller 22 fixes the toner image T on the paper P. The paper P is carried from the fixing nip between the fixing roller 21 and the pressure roller 22 in the direction of arrow Y2 shown in FIG. 2. The surface of the fixing roller 21 that passed the fixing nip N rotates and then faces induction heating unit 25 again.

The fixing unit 20 in this embodiment uses induction heating unit 25. However a halogen heater may additionally or alternately be used as the heater. A fixing belt that is an endless belt is available as the fixing member. It is also possible to omit the heater 23 in the pressure roller 23. Other fixing units that have different structures may also be utilized.

Figure 3:
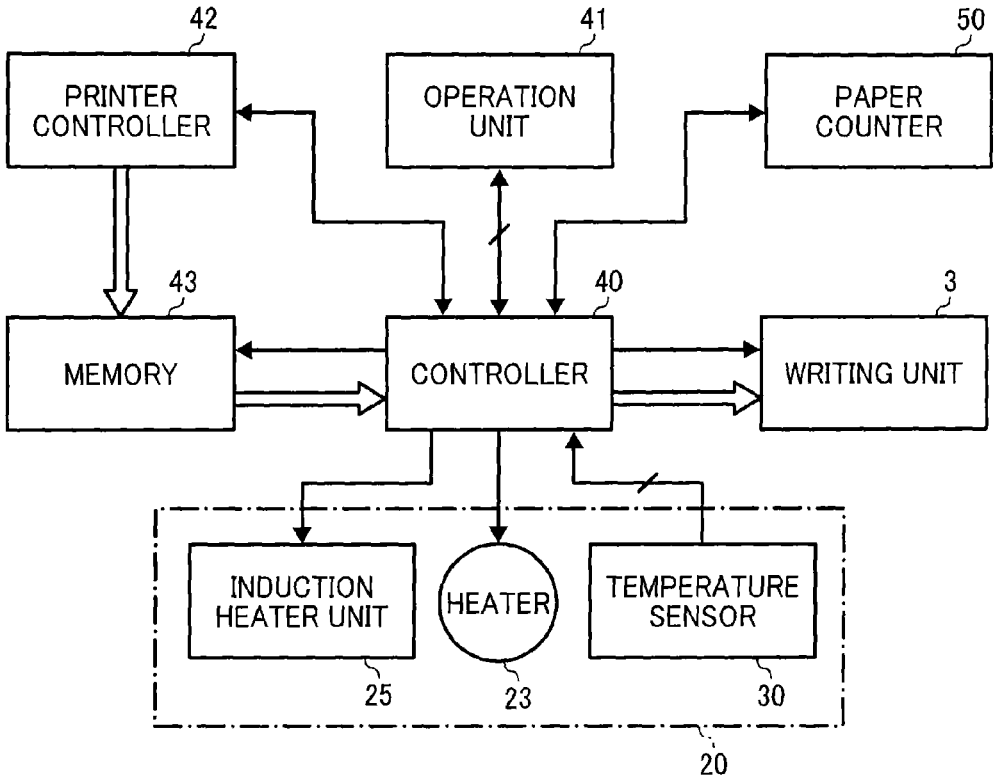
FIG. 3 is a block diagram showing an exemplary control system.

An exemplary control system of the image forming apparatus shown in FIG. 1 and FIG. 2 is explained using FIG. 3 which is a block diagram of an exemplary control system.

A controller 40 controls the exemplary image forming apparatus and has a microcomputer that includes a CPU, a ROM storing a program and fixed data, and a RAM which stores data. The controller may include a non-volatile memory such as a Flash memory, if desired.

An operation unit 41 is disposed at an upper part of the image forming apparatus 1 shown in FIG. 1 to be easily accessible. The operation unit 41 has a display such as a liquid crystal display panel and an input part comprising keys or a touch panel, for example. The controller 40 controls the operation unit to inform a user of the machine status and to show an instruction image for the user's choice or the user's input. A user's operation of the input part generates many kinds of input information such as mode choice, paper choice, white space size, and a need for automatic control of the fixing temperature. The information is inputted in the controller 40.

A printer controller 42 converts image data from a host apparatus (for example, the data from a personal computer via a network) to image data that is available in the image forming apparatus 1 and sends it to a memory 43. The memory 43 stores it temporarily The memory 43 is an image memory that has storage capacity to store a large amount of image data. The memory 43 may be implemented as a hard disk drive or as a semiconductor based memory such as Flash memory or a Flash drive, for example. The memory stores image data from the scanner 2 temporarily when the scanner reads a document. The image data is generated from photoelectric converted signals outputted from an image sensor 205 in the scanner 2 shown in FIG. 1 by a signal processing circuit that executes various types of image processing operations.

The printer controller 42 and the memory 43 are connected to the controller 40. The controller 40 sequentially reads each page of image data in the temporarily stored image data of the memory 43 and sends the data to the exposure unit 3 shown in FIG. 1. The exposure unit 3 generates laser beams for yellow, magenta, cyan, and black images, and exposes each charged photoconductor 11Y, 11M, 11C, 11BK in the image forming unit 4. After that, as stated before, by the developing process, the first transfer process and the second transfer process, a full color toner image is formed on the paper P.

The white space that has no toner at the tip or edge of the paper P in the moving direction of paper P can be set after the second transfer process by delaying the start timing of exposure by the laser beams corresponding to the image data in the exposure unit 3 from the timing that is set for the tip of the image data and the tip of the paper based on the carrying paper start timing by the resist rollers to the second transfer position. This white space is set or created, even if the image data does not include white space. The controller sets this white space and controls its adjustment.

The controller 40 controls the fixing unit 20 shown in FIGS. 1 and 2. A temperature sensor 30 including thermistors 35 and 36 and two thermopiles previously described detect the surface temperature of the fixing roller 21 and pressure roller 22 from the image forming start to the image forming end. The detected temperature information is inputted to the controller 40. The controller 40 controls the current to the induction heating unit 25 and the heater 23 to keep the detected temperature at a predetermined target fixing temperature.

If the heater 23 is not in the pressure roller 22, the thermistor 35 and the thermopile for detecting the surface temperature of the pressure roller 22 are not needed. In such a case, the temperature sensor 30 including the thermistor 36 and the thermopile detects only the surface temperature of the fixing roller 21, for example. The detected temperature information is inputted to the controller 40. The controller 40 controls the current to the induction heating unit 25 to keep the detected temperature at the target fixing temperature.

A paper counter 50 is a counter that counts the number of papers P passing through the fixing nip N in the fixing unit 20 shown in FIG. 2. For example, a sensor such as a photosensor is set between the pair of the output paper rollers 9 and the fixing unit 20 shown in FIG. 1 in order to detect passing the paper P. The detected passing signals are counted up. The paper counter may be a soft-counter that counts the input of the above detected passing signals by computer program of the microcomputer in the controller 40 and stores the counted data in a non-volatile memory. Alternatively, another soft-counter that counts the number of execution of image making action program may be used without using above sensor, as explained below.

The controller 40 controls the size of the white space and the target fixing temperature regarding to the white space based on the number of pieces of paper counted by the paper counter 50. The details of this process are explained below.

Figure 4:
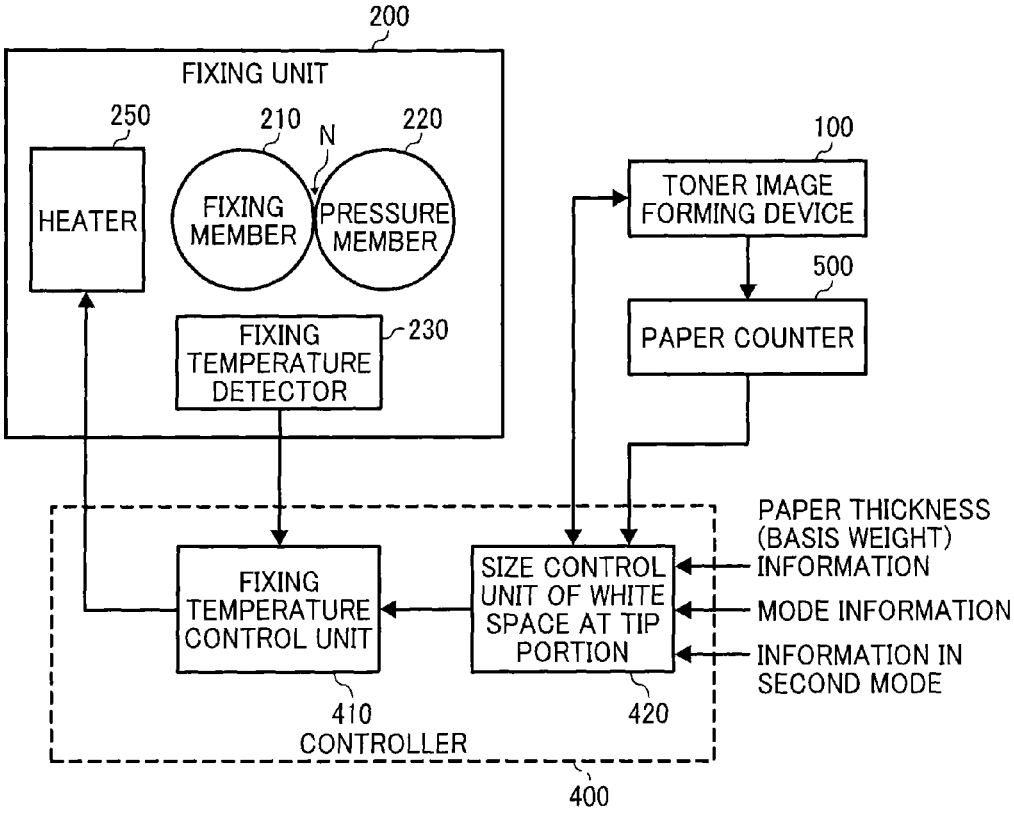
FIG. 4 is a block diagram showing an exemplary relationship among each unit in the image forming apparatus.

Next the function of this embodiment is explained with respect to FIG. 4. FIG. 4 is a block diagram showing the structure of the image forming apparatus of this embodiment in block diagram format. The image forming apparatus in this embodiment includes a toner image forming device 100 to form a toner image on a recording medium based on image information, a fixing unit 200 to fix the toner image on the recording medium, a paper counter 500 to count the number of sheets of the recording medium passing through the fixing nip N in the fixing unit 200, and a controller that controls the elements of the image forming apparatus.

The fixing unit 200 has a fixing member 210, a pressure member 220 that forms the fixing nip N by pressing against the fixing member 210, a heater 250 that heats both the fixing member 210 and pressure member 220, or alternatively just the temperature of the elements of the fixing unit 200, or at least the fixing member 210 and a fixing temperature detector 230 that detects them or at least the fixing member 210. A toner image is fixed on the recording medium by heat and pressure when the toner image on the paper passes through the fixing nip N. There is a mechanism that presses the pressure member 220 against the fixing member 210 and releases the pressure when it is needed.

A controller 400 includes a fixing temperature control unit 410 that controls the heater 250 to keep a temperature detected by the fixing temperature detector 230 in the fixing unit 200 to the predetermined target fixing temperature (Ts° C.) and a size control unit of a white space at tip portion 420. In this embodiment, the target fixing temperature (Ts° C.) is from 160° C. to 165° C., for example. However it is preferable to change the target fixing temperature based on conditions such as a type of the recording medium, their sizes (width and length), and a process speed or speed of the recording medium.

A size control unit of white space at tip portion 420 sets the toner image forming device 100 to make a predetermined size white space that has no toner at the tip of the recording medium in the direction of the recording medium movement. The size of white space is increased when the paper count counted by the paper counter 500 becomes equal to or greater than a predetermined threshold value. Additionally, the fixing temperature control unit 410 lowers the target fixing temperature when the white space on the recording medium passes through the fixing nip N, if desired.

By setting the above white space at the tip of the recording medium in its moving direction (e.g., at the top or front of the page) in accordance with the predetermined paper counts (e.g., above the predetermined threshold value), a wrapping jam around the fixing member 210 or the pressure member 220 is prevented. When this exemplary image forming apparatus prints an image that is a document or a picture sent from a personal computer, the wrapping jam does not readily happen because white space generally occurs around the printed image, and also at the tip of the recording medium.

However, a copier image sometimes has an image at the tip of the recording medium, and some images generated by the printer function do not have white space. (e.g., photography image). To prevent the wrapping jam in such a case, some white space is desired at the tip of the recording medium. For example, in this exemplary image forming apparatus, the size of the white space is preferably from 3 mm to 5 mm.

Additionally, when the number of sheets of the recording medium is equal to or greater than the predetermined value, the size of white space at the tip of the recording medium in the direction of the recording medium moving is increased. Preferably when the white space passes the fixing nip N, the target fixing temperature is set lower. Then the wrapping jam due to time degradation is prevented.

Generally, the outer peripheries of the fixing member 210 and the pressure member 220 which form the nip are made of a soft material such as sponge or foam. Therefore, after many recording medium pass through the fixing nip N, the nip forming member deteriorates. As a result, the curvature at the fixing nip N becomes greater. Then the frequency of wrapping jams increases.

When toner melts, it may have properties similar to glue between a sheet of paper and a roller, the paper adheres to the roller, and a wrapping jam occurs. So, when the tip of the recording medium passes the fixing nip, a high fixing temperature melts toner and causes wrapping jam. Therefore, when the number of the recording medium count is equal to or greater than the predetermined value, the size of white space at the tip of the recording medium is increased. When the white space passes the fixing nip N, the target fixing temperature is set lower instantaneously, and subsequently returns to the preferred fixing temperature set for the image, thus preventing the wrapping jam. This does not affect the fixing quality. The target fixing temperature may be set lower instantaneously for a short time in order not to affect fixing quality. For example, the target fixing temperature may be set lower instantaneously only when the increased white space passes the fixing nip N. Additionally or alternatively, the target fixing temperature may be set lower instantly after the toner image passes the fixing nip N and before the next toner image comes to the fixing nip N.

The relationship between the structure of FIG. 4 and the structure of FIG. 1, FIG. 2 and FIG. 3 are explained. The toner image forming device 100 forms a toner image on a sheet of paper before it is fixed. In the image forming apparatus 1 shown in FIG. 1, there is the exposure unit 3, the image forming unit 4, the transfer unit 5, the paper feeding unit 7, the paper feeding roller 8, the pair of output paper rollers 9, the pair of carrying paper rollers 10, and the second transfer roller 18. The image forming apparatus includes most of the structures other than the scanner 2 and the fixing unit 20. The recording medium is the paper P in FIG. 1, and may be a medium that has a sheet form and is able to have a toner image formed thereon. The recording medium can be any type of recording medium such as paper, transparencies, envelopes, card stock, or any other type of recording medium.

The fixing unit 200 corresponds to the fixing unit 20. The fixing member 210 corresponds to the fixing roller 21. The pressure member 220 corresponds to the pressure roller 22. The heater 250 corresponds to the heater 23 and the induction heating unit 25 shown in FIG. 2. If there is no heater for the pressure roller, the heater 250 corresponds to only heating means for the fixing roller 21 such as the induction heating unit 25. The fixing temperature detector 230 corresponds to the thermistors 35 and 36 as the contact-type temperature sensor shown in FIG. 2, and the thermopiles as a noncontact-type temperature sensor that is near the surface of the center of the fixing roller 21 and the center of the pressure roller 22 in their axis direction. If there is no heater for the pressure roller, the fixing temperature detector 230 corresponds to at least the thermistor 36 and the thermopile that detects the temperature of the fixing roller 21, although only one of these can be used, if desired.

The controller 400 corresponds to the controller 40 shown in FIG. 3. The controller 400 includes the fixing temperature control unit 410 and the size control unit of white space at tip portion 420 in FIG. 4. The paper counter 500 corresponds to the paper counter 50. The soft-counter previously described may be utilized.

Three specific examples showing the control of the white space at the tip of the recording medium by the size control unit of white space at a tip portion 420 are explained as follows. In the following explanation, the white space that has no toner at the tip of the recording medium in the direction of the recording medium (the paper) is called "tip white space."

The first example shown in table 1 is a basic example. Assuming a life of the fixing member 210 in the fixing unit 200 is 300,000 sheets of paper, table 1 shows a paper or image count, a changed (increased) white space value (mm) for the white space at the tip of the paper corresponding to the paper count, and a changed fixing temperature difference (° C.) while the white space passes through the fixing nip.

TABLE 1

| Paper Count | Changed White Space Value | Changed Fixing Temperature (° C.) |
|---|---|---|
| 0-99,999 | 0 | 0 |
| 100,000- | 1 | −10 |

In this example 1, a threshold value for changing the conditions is set to 100,000 papers. When the paper count counted by the paper counter 500 is less than 100,000, the changed white space value is 0 mm. Therefore the size of the white space is set to a first or original value (for example, 3 mm). As the size of white space is not changed, the fixing temperature is not changed. That is, the fixing temperature is set to a predetermined value (for example 160° C.).

When the paper count is equal to or more than 100,000, the changed white space value is 1 mm, for example. Then the size of the white space is increased by 1 mm. The changed fixing temperature is −10° C. at that time. Then the fixing temperature is decreased by 10° C. while the white space passes through the fixing nip. For example, when the fixing temperature is set to 160° C., the fixing temperature is set to 150° C. while the white space passes through the fixing nip. After the white space passes through the fixing nip, the fixing temperature returns to 160° C. The time duration at which the fixing temperature is lowered may be set short. For example, only when the increased white space passes through the fixing nip, the fixing temperature is lowered. That is, while the increased 1 mm of the white space passes through the fixing nip, the fixing temperature is set to 150° C. in the above case. A fixing unit with a small heat capacitance can change the fixing temperature rapidly. Therefore, after the white space goes through the fixing nip, the fixing temperature returns to the set value for toner image fixing. The fixing unit illustrated in the Figures and described herein is an example of a fixing unit with a small heat capacitance.

Next, a more preferable control by the size control unit of white space at tip portion 420 is explained. When paper count counted by the paper counter 500 is equal to or more than a predetermined threshold, the size control unit of white space at tip portion 420 increases the size of the white space at the tip of the paper step by step in accordance with the paper count. Additionally, the changed fixing temperature is decreased step by step in accordance with increasing the size of the white space. An example is shown in Table 2.

TABLE 2

| Paper Count | Changed White Space Value (mm) | Changed Fixing Temperature (° C.) |
|---|---|---|
| 0-99,999 | 0 | 0 |
| 100,000-149,999 | 1 | −10 |
| 150,000-199,999 | 2 | −8 |
| 200,000-249,999 | 3 | −6 |
| 250,000-299,999 | 4 | −4 |
| 300,000- | 5 | −2 |

In this example 2, when the paper count is more than 100,000, the size control unit of white space at tip portion starts its control. The changed white space value is increased from 1 mm step by step in accordance with the paper count. When the paper count is from 100,000 to 149,999, the changed white space value becomes 1 mm. When the paper count is equal to or more than 150,000, the changed white space value becomes 2 mm. When the paper count is equal to or more than 200,000, the changed white space value becomes 3 mm. When the paper count is equal to or more than 250,000, the changed white space value becomes 4 mm. When the paper count is equal to or more than 300,000, the changed white space value becomes 5 mm. This table shows that the white space is increased step by step. According to an alternate embodiment, the changed white space and/or changed fixing temperature can be changed in a smooth or gradually changing manner instead of changing in a step manner.

Although the increase of the paper count tends to increase the frequency of wrapping jams, the above control prevents the wrapping jams because it increases the size of white space in accordance with the increase of the count of the number of sheets of paper which are printed.

On the other hand, the changed fixing temperature that lowers the fixing temperature at the white space is decreased, as shown in table 2, in accordance with the increase of the size of the white space corresponding to the paper count. When the paper count is from 100,000 to 149,999, the changed fixing temperature becomes −10° C. When the paper count is equal to or more than 150,000, the changed fixing temperature becomes −8° C. When the paper count is equal to or more than 200,000, the changed fixing temperature becomes −6° C. When the paper count is equal to or more than 250,000, the changed fixing temperature becomes −4° C. When the paper count is equal to or more than 300,000, the changed fixing temperature becomes −2° C. This control prevents bad fixing quality at the tip of the toner image on a sheet.

When the paper count counted by the paper counter is equal to or more than the predetermined number, the changed white space value and changed fixing temperature may be changed in accordance with a basis weight (weight per 1 $m^2$ of the paper [$g/m^2$]) that corresponds to the paper thickness. In such a case, the changed white space value and the changed fixing temperature is decreased in accordance with the increase of paper thickness (basis weight), as set forth in example 3 shown in table 3, below.

TABLE 3

| Paper Type | Basis Weight (g/m2) | Control Parameter for White Space | Control Parameter for Fixing Temperature in White Space |
|---|---|---|---|
| thin paper | 52-59 | 1 | 1 |
| normal paper | 60-81 | 0.8 | 0.9 |
| thick paper 1 | 82-169 | 0.6 | 0.8 |
| thick paper 2 | 170-220 | 0.4 | 0.7 |
| thick paper 3 | 221-256 | 0.2 | 0.6 |

The control parameter for white space in table 3 is the parameter that adjusts the changed white space value in table 1 and table 2 in accordance with the basis weight in table 3. The changed white space value in each basis weight is the changed white space value in table 1 and table 2 multiplied by the control parameter for white space in table 3 corresponding to the basis weight. The control parameter for fixing temperature in white space in table 3 is the parameter that adjusts the changed fixing temperature in table 1 and table 2 in accordance with the basis weight in table 3. The changed fixing temperature in each basis weight is the changed fixing temperature in table 1 and table 2, multiplied by the control parameter for fixing temperature in white space in table 3 corresponding to the basis weight. In this example 3 of table 3, both control parameters are changed step by step at the same time in accordance with basis weight that shows paper thickness. Alternatively, only one of the control parameters can be changed, if desired.

As an example of operation with both control parameters being changed, when the third example in table 3 is applied to the second example in table 2 and the paper count is 180000, image forming on thick paper 1 is set so that the changed white space value equals 2×0.6=1.2 (mm) and the changed fixing temperature equals −8×0.8=−6.4° C. Therefore, when the setting condition is the white space at the tip portion 3 mm and the target fixing temperature 160° C., in the above case, the white space at the tip portion is 3+1.2=4.2 (mm) and the target fixing temperature is 160−6.4=153.6° C.

The bigger basis weight means that the thicker paper has a smaller changed white space value and a smaller changed fixing temperature. This is because thin paper having a basis weight which is less than 59 (g/m$^2$) has a small stiffness. Therefore, a wrapping jam easily occurs to such thin paper. To prevent a wrapping jam in thin paper, a bigger white space and a lower target fixing temperature is preferable. Also, thicker paper has a greater stiffness that causes less wrapping jams.

The size control unit of white space at tip portion 420 may be set to a first mode that automatically changes the size of the white space and the fixing temperature when the paper count counted by the paper counter 500 is equal to or more than the predetermined number and a second mode that changes the size of the white space and the fixing temperature only when users set the above control in an operation unit. In such a case, users can choose the mode by setting the operation unit 41 in FIG. 3. Mode information (first mode or second mode) and information regarding the second mode (above automatic control or no change) is inputted from the operation unit 41 to the size control unit of white space at tip portion 420.

Another exemplary image forming apparatus measures total length of the recording medium instead of counting pages using the paper counter 500. The size control unit of the white space at the tip portion executes its control based on the total length of the recording medium P measured by a device or detector which detects or calculates the length of paper which has passed through the device or nip. In this writing, a counter is any device, structure, and/or algorithm which determines the amount of paper or recording media picked up, processed, and/or fixed. Thus, the counter can count the number of sheets of the recording media processed or fixed, but additionally or alternatively, the counter may count rotations of a roller, or otherwise determine a length of recording media which is utilized.

The total length of the recording medium is obtained by summing up the recording medium length passing the fixing nip. However it may be the rotation length determined by multiplying an apparatus action time (such as a motor) by a fixing member rotational speed. Alternatively, the length may be determined by multiplying the paper count N by a paper length L. In this case, the total length is related to the paper count. Therefore it is straightforward to determine.

Numerous additional modifications and variations of the exemplary embodiments are possible in light of the above teachings. It is therefore to be understood that within the scope of the appended claims, the embodiments may be practiced otherwise than as specifically described herein.

What is claimed is:

1. An image forming apparatus, comprising:

a toner image forming device that forms a toner image on a recording medium;

a fixing unit including:

a fixing member, a pressure member that presses the fixing member to form a fixing nip, a heater that heats the fixing member, and a fixing temperature detector that detects the temperature of the fixing member, a recording medium counter that counts recording media processed by the image forming apparatus;

a size control unit of white space at a tip portion that controls the toner image forming device not to form the toner image at a tip of the recording medium in a direction of moving of the recording medium to make a white space of a predetermined size, and to increase a white space size when the number counted by the recording medium counter is more than a predetermined number; and a fixing temperature control unit that controls the heater to be a target fixing temperature, and decreases the target fixing temperature when the white space on the recording medium passes the fixing nip and the number counted by the recording medium counter is more than a predetermined number.

2. The image forming apparatus according to claim 1, wherein the size control unit increases the white space size in steps according to the number counted by the recording medium counter, and decreases the target fixing temperature in steps as the number counted increases.

3. The image forming apparatus according to claim 1, wherein the size control unit changes an increment of the white space size and a decrement of the target fixing temperature as the number counted by the recording medium counter according to information of a thickness of the recording medium.

4. The image forming apparatus according to claim 3, wherein the size control unit control the increment of the white space size and the decrement of the target fixing temperature to be smaller for a thicker recording medium.

5. The image forming apparatus according to claim 1, wherein the size control unit operates in at least two modes which include:

a first mode in which the size control unit changes the white space size and the target fixing temperature automatically according to the number counted by the recording medium counter, and a second mode in which the size control unit changes the white space size and the target fixing temperature only when setting the change is requested.

6. The image forming apparatus according to claim 1, wherein:

the recording medium counter determines a cumulative length of the recording media processed by the image forming apparatus.

7. The image forming apparatus according to claim 6, wherein:

the recording medium counter determines the cumulative length of the recording media which passes through the nip of the fixing unit.

8. The image forming apparatus according to claim 1, wherein:

the recording medium counter counts a number of sheets processed by the image forming apparatus.

9. The image forming apparatus according to claim 8, wherein:

the recording medium counter counts the number of sheets of the recording medium which passes through the nip of the fixing unit.

10. The image forming apparatus according to claim 1, wherein the fixing temperature control unit decreases the target fixing temperature only when the white space on the recording medium passes the fixing nip.

11. The image forming apparatus according to claim 1, wherein the fixing temperature control unit decreases the target fixing temperature only when the white space on the recording medium resulting from an increase of the white space passes the fixing nip.

12. An image processing method, comprising:

forming a toner image on a recording medium with a white space at a tip portion of the recording medium;

transporting the recording medium with the toner image through a fixing nip formed between a fixing member controlled to maintain a target fixing temperature, and a pressure member that presses the fixing member;

determining an amount of recording media which have been processed; and changing a size of the white space and the target fixing temperature according to the amount of the recording media which have been processed.

13. The method according to claim 12, wherein the determining of the amount of recording media comprises:

counting a number of sheets which have been processed.

14. The method according to claim 12, wherein the determining of the amount of recording media comprises:

counting a number of sheets which have been fixed at the fixing nip.

15. The method according to claim 12, wherein the determining of the amount of recording media comprises:

determining a cumulative length of the recording media processed by the image forming apparatus.

16. The method according to claim 15, wherein the determining of the amount of recording media comprises:

determining the cumulative length of the recording media which passes through the nip of the fixing unit.

17. The method according to claim 12, wherein the changing is performed according to a thickness of the recording medium.

* * * * *